US008797189B2

(12) United States Patent
Komeda et al.

(10) Patent No.: US 8,797,189 B2
(45) Date of Patent: Aug. 5, 2014

(54) CONTROL DISPLAY SYSTEM, METHOD, AND PROGRAM

(75) Inventors: Munehiro Komeda, Tokyo (JP); Takahiro Katoji, Tokyo (JP); Toshiaki Otaka, Tokyo (JP); Motofumi Naruto, Aichi (JP)

(73) Assignees: Mitsubishi Heavy Industries, Ltd., Tokyo (JP); NEC Corporation, Tokyo (JP)

( * ) Notice: Subject to any disclaimer, the term of this patent is extended or adjusted under 35 U.S.C. 154(b) by 638 days.

(21) Appl. No.: 13/053,493

(22) Filed: Mar. 22, 2011

(65) Prior Publication Data

US 2012/0242509 A1 Sep. 27, 2012

(51) Int. Cl.
*G08B 23/00* (2006.01)

(52) U.S. Cl.
USPC ..... 340/963; 340/945; 340/961; 340/973; 701/120; 701/301

(58) Field of Classification Search
USPC ..... 340/963, 973, 961, 969, 953, 980, 990, 340/995.1, 945; 701/8, 9, 14, 15, 120, 301
See application file for complete search history.

(56) References Cited

U.S. PATENT DOCUMENTS

| | | | | |
|---|---|---|---|---|
| 5,724,040 | A * | 3/1998 | Watnick | 342/26 D |
| 5,907,568 | A * | 5/1999 | Reitan, Jr. | 342/26 B |
| 6,047,233 | A * | 4/2000 | Salvatore et al. | 701/120 |
| 7,030,780 | B2 * | 4/2006 | Shiomi et al. | 340/961 |
| 2010/0191467 | A1 * | 7/2010 | Wise et al. | 701/301 |

FOREIGN PATENT DOCUMENTS

| | | |
|---|---|---|
| JP | 2000-276700 | 10/2000 |
| JP | 2001-266298 | 9/2001 |
| JP | 2002-024862 | 1/2002 |
| JP | 2003-132499 | 5/2003 |
| JP | 2004-503843 | 2/2004 |
| JP | 2007-193419 | 8/2007 |
| JP | 2009-528203 | 8/2009 |

OTHER PUBLICATIONS

Japanese Notification of Reason for Rejection issued on Jun. 18, 2013 in corresponding Japanese Patent Application No. 2009-282091 with English translation.
Decision to Grant a Patent issued Mar. 25, 2014 in related Japanese Application No. 2009-282091.

* cited by examiner

*Primary Examiner* — Hung T. Nguyen
(74) *Attorney, Agent, or Firm* — Wenderoth, Lind & Ponack, L.L.P.

(57) ABSTRACT

The degree of urgency of a displayed object is promptly recognized in a control display system including: an information acquisition unit that acquires a target serving as an object of monitoring and attribute information of the target; a control condition storage unit that stores the attribute information of the target and a viewpoint control condition serving as information about a display mode of the target, the attribute information and the condition being associated with each other in advance; a viewpoint control unit that detects attribute information matching the attribute information of the acquired target from the control condition storage unit and that extracts the viewpoint control condition associated with the detected attribute information; and a display unit that displays a result obtained by carrying out viewpoint control of the target on the basis of the extracted viewpoint control condition.

13 Claims, 9 Drawing Sheets

FIG. 2

EXAMPLE OF VIEWPOINT CONTROL CONDITIONS

```
<CONDITION     TARGET TYPE=AIRPLANE>
     <CONDITION     NATIONALITY OF TARGET ≠ JAPAN>
       <CONDITION     ALTITUDE OF TARGET<3000 FEET>>
              <DISPLAY CENTER OF STATE DISPLAY = TARGET POSITION>
       </CONDITION>
     </CONDITION>
</CONDITION>
```

FIG. 7

EXAMPLE OF CONDITIONS OF ALERT PRIORITY

```
<CONDITION    TARGET TYPE=AIRPLANE>
  <CONDITION    NATIONALITY OF TARGET ≠ JAPAN>
    <CONDITION    ALTITUDE OF TARGET<3000 FEET>>
      <CHANGE PRIORITY TO 1>
    </CONDITION>
  </CONDITION>
</CONDITION>
```

CONTROL DISPLAY SYSTEM, METHOD, AND PROGRAM

CROSS-REFERENCE TO RELATED APPLICATIONS

This application is based on Japanese Patent Application No. 2009-282091, the contents of which are incorporated herein by reference.

TECHNICAL FIELD

The present invention relates to control of a control display system installed in a control station of, for example, airplanes.

BACKGROUND ART

Conventionally, in state display of a control device which monitors flying objects such as airplanes, viewpoint control such as setting of a display range and the center position of display has been carried out manually by operators. In the above described control display system, the alerts which are generated when the modes of targets are changed are displayed by the priorities fixed respectively for the types of the alerts. The alert messages having the same priority are displayed in the generated order of the alerts.

CITATION LIST

Patent Literature

PTL 1
Japanese Unexamined Patent Application, Publication No. 2002-24862

SUMMARY OF INVENTION

Technical Problem

In the above described conventional control device, individually changing display ranges and display modes respectively for the flying objects has not been carried out; for example, the flying object having a high degree of attention and the flying object having a low degree of attention are uniformly displayed; therefore, it has been difficult for observers who are watching a state display screen to distinguish the flying object having the high degree of attention from others.

Even when an alert that has to be promptly recognized by the observers and has a high degree of attention is generated, alerts are displayed in the generation order of the alerts on the basis only of fixed priorities; therefore, it has been impossible to distinguish the flying object having the high degree of attention from others and notice the alert having a higher priority than others.

The present invention has been accomplished in order to solve the above described problems, and it is an object of the present invention to provide a control display system, a control display method, and a control display program capable of implementing an appropriate display mode in accordance with, for example, the degrees of attention of monitoring objects.

Furthermore, it is another object of the present invention to provide a control display system, a control display method, and a control display program capable of rearranging and displaying the order of alerts in the descending order of the degrees of importance.

Solution to Problem

In order to solve the above described problems, the present invention employs the following solutions.

A first aspect of the present invention is a control display system having: an information acquisition unit that acquires a target serving as an object of monitoring and attribute information of the target; a control condition storage unit that stores the attribute information of the target and a viewpoint control condition serving as information about a display mode of the target, the attribute information and the condition being associated with each other in advance; a viewpoint control unit that detects attribute information matching the attribute information of the target acquired by the information acquisition unit from the control condition storage unit and that extracts the viewpoint control condition associated with the detected attribute information; and a display unit that displays a result obtained by carrying out viewpoint control of the target on the basis of the viewpoint control condition extracted by the viewpoint control unit.

According to the first aspect of the present invention, when the target serving as the object of monitoring is detected, the viewpoint control condition corresponding to the attribute information of the target is extracted from the control condition storage unit, and a screen which has undergone the viewpoint control corresponding to the viewpoint control condition is displayed on the display unit. Therefore, the mode of display can be changed in accordance with the attribute information of the target. Therefore, for example, when appropriate viewpoint control conditions are defined in accordance with the moving state, type, etc. of the target, the target can be displayed on the display unit in an appropriate display mode in accordance with the moving state and type. For example, regarding a target having a high degree of attention, in other words, a high degree of urgency, when the viewpoint control conditions by which the movement of the target is displayed in detail are defined, an observer can recognize the degree of attention, degree of urgency, or the like of the target.

The attribute information of the above described target includes at least one of: the information about movement of the target and the information about the type of the target.

The control display system may be configured to have an information comparison unit that compares the attribute information of the target acquired from the information acquisition unit with past attribute information of the target and that determines whether the attribute information is changed or not; wherein, when the attribute information is changed, the viewpoint control unit extracts the viewpoint control condition.

Since the information comparison unit which compares the current attribute information of the target with the past attribute information is provided in this manner, for example, whether the target has been moved or not can be determined. Consequently, only the moved target or the like can be subjected to the viewpoint control corresponding to the movement. As a result, the observer can be informed of the approaching state of the target.

The control display system may be configured so that the attribute information of the target is set in multiple levels in a viewpoint control condition storage unit.

When the attribute information of the target is set in the multiple levels in this manner, for example, appropriate viewpoint conditions corresponding to the detailed attribute information of the type or moving state of the target can be set. As a result, detailed viewpoint control corresponding to the attribute information of the target can be carried out.

A second aspect of the present invention is a control display system having: an information acquisition unit that acquires a target serving as an object of monitoring and attribute information of the target; an alert priority storage unit that stores the attribute information of the target and a priority of an alert message, the attribute information and the priority being associated with each other; an alert control unit that detects attribute information matching the attribute information of the target acquired by the information acquisition unit from the alert priority storage unit and that extracts an order of the alert message associated with the detected attribute information; and a display unit that displays the alert message on the basis of the extracted alert order.

According to the second aspect of the present invention, for example, when a detected object approaches a certain range, an alert message is generated, and alert messages are rearranged on the basis of the priorities in the alert messages. Therefore, an alert having a high degree of importance such as an alert that the target serving as the object of monitoring is coming closer to a neighboring area can be displayed at a higher level than the other alert messages. As a result, the observer can easily notice the important alert message, and the observer can be caused to recognize the alert having a higher degree of urgency.

The control display system according to the second aspect may be configured so that, when an unshown message is present other than the alert message displayed by the alert display unit, the number of the unshown message is displayed.

When the alert message other than the alert message which is currently displayed by the alert display unit is present in this manner, the number of the remaining alert messages can be displayed on the screen together with display of the current alert message. Therefore, the observer can be aware of the generation state of the alert messages.

A third aspect of the present invention is a control display method including: a first step for acquiring a target serving as an object of monitoring and attribute information of the target; a second step for detecting attribute information matching the attribute information of the target acquired in the first step from information including the attribute information of the target and a viewpoint control condition serving as information about a display mode of the target, which are associated with each other in advance, and for extracting the viewpoint control condition associated with the detected attribute information; a third step for displaying a result obtained by carrying out viewpoint control of the target on the basis of the viewpoint control condition extracted in the second step.

A fourth aspect of the present invention is a control display program for causing a computer to execute: a first process for acquiring a target serving as an object of monitoring and attribute information of the target; a second process that detects attribute information matching the attribute information of the target acquired in the first process from information including the attribute information of the target and a viewpoint control condition serving as information about a display mode of the target, which are associated with each other in advance, and that extracts the viewpoint control condition associated with the detected attribute information; a third process for displaying a result obtained by carrying out viewpoint control of the target on the basis of the viewpoint control condition extracted in the second process.

A fifth aspect of the present invention is a control display method including: a first step for acquiring a target serving as an object of monitoring and attribute information of the target; a second step for detecting attribute information matching the attribute information of the target acquired in the first step from information including the attribute information of the target and a priority of an alert message, which are associated with each other, and for extracting an order of the alert message associated with the detected attribute information; and a third step for displaying the alert message on the basis of the extracted alert order.

A sixth aspect of the present invention is a control display program for causing a computer to execute: a first process for acquiring a target serving as an object of monitoring and attribute information of the target; a second process for detecting attribute information matching the attribute information of the target acquired in the first process from information including the attribute information of the target and a priority of an alert message, which are associated with each other, and extracting an order of the alert message associated with the detected attribute information; and a third process for displaying the alert message on the basis of the extracted alert order.

Advantageous Effects of Invention

According to the present invention, the degree of urgency of the displayed object can be promptly recognized in the control display system.

Furthermore, according to the present invention, the order of the alert messages, which are the alert about the targets, can be rearranged and displayed in the descending order of the degree of importance.

BRIEF DESCRIPTION OF DRAWINGS

FIG. 2 shows an example of viewpoint control conditions.

FIG. 7 shows an example of alert priorities.

DESCRIPTION OF EMBODIMENTS

Hereinafter, embodiments of a control display system, method and a control management program according to the present invention will be explained sequentially from [First Embodiment] to [Second Embodiment] with reference to drawings.

First Embodiment

Figure 1:
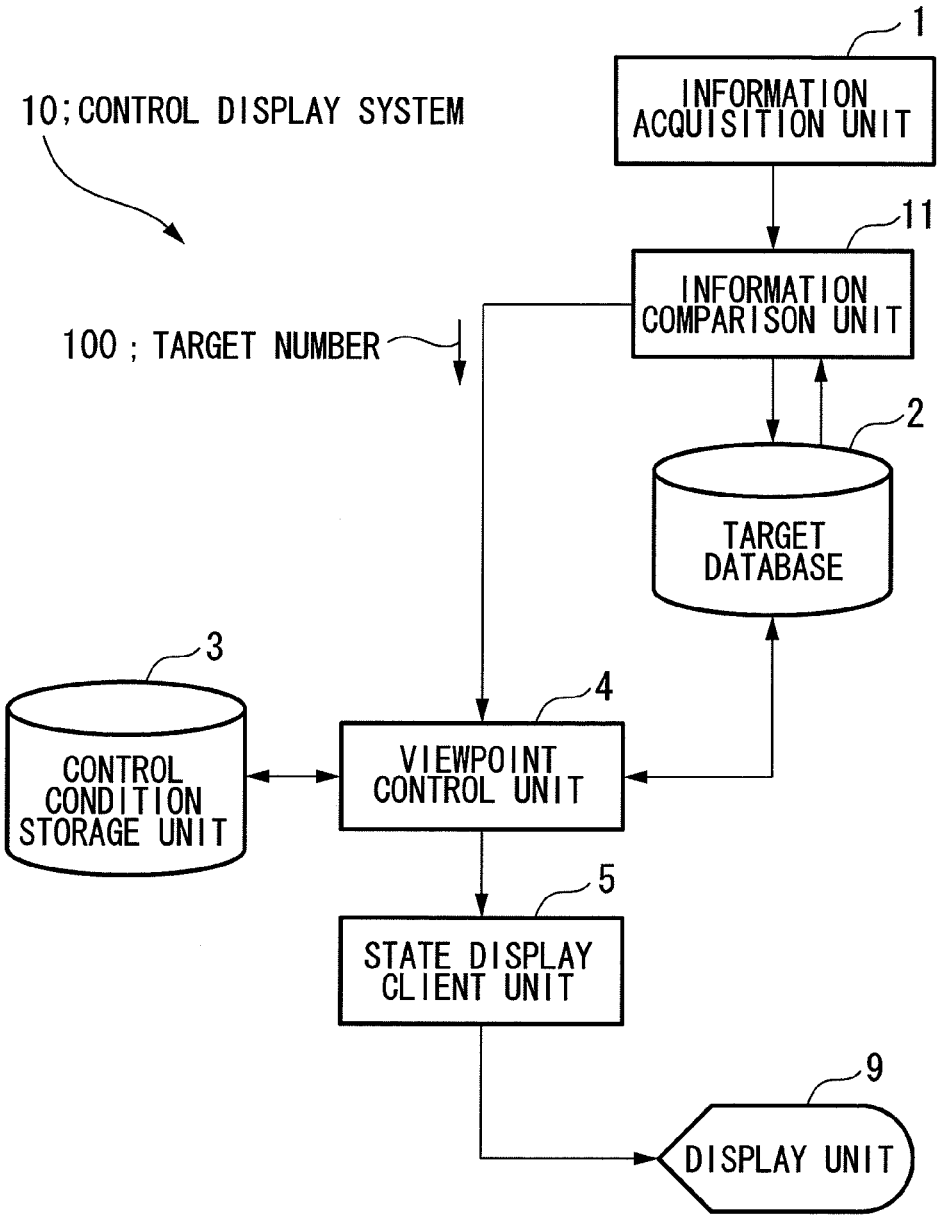
FIG. 1 is a functional block diagram showing an example of the configuration of a control display system according to a first embodiment of the present invention.

FIG. 1 is a functional block diagram showing a schematic configuration of the control display system according to the present embodiment.

As shown in FIG. 1, the control display system 10 according to the present embodiment has: an information acquisition unit 1, a target database 2, a control condition storage unit 3, a viewpoint control unit 4, a state display client unit 5, a display unit 9, and an information comparison unit 11 as main constituent elements.

In the control display system 10, the information acquisition unit 1 uses an object, which is manually input by an operator or automatically input by radar detection, as a target; allocates a target number, which is a unique identification number, to the target; and acquires attribute information such as the type, course, speed, and position of the target. The target number and the attribute information of the target are output to the information comparison unit 11. Specifically, if the target input by the operator is a flying object, the information acquisition unit 1 sets 100 as the target number of the flying object and acquires the attribute information such as the position/speed and position information of the target number 100. The attribute information associated with the target number 100 is output to the information comparison unit 11.

The information comparison unit 11 acquires past attribute information of the target number, which is input from the information acquisition unit 1, from the target database 2 and compares the attribution information input from the information acquisition unit 1 with this past attribute information, thereby determining whether the attribute information of the target number, which is input from the information acquisition unit 1, has been changed or not. When the attribute information has been changed as a result of the determination, for example, when the target has been newly added or when the target has been moved, the target number is output to the viewpoint control unit 4, and the attribute information thereof input from the information acquisition unit 1 is associated with the target number and stored in the target database 2. On the other hand, when the attribute information has not been changed as a result of the determination, the attribute information and the target number are associated with each other and stored in the target database 2 without outputting the target number to the viewpoint control unit 4.

As a result, the histories of the attribute information of the targets acquired by the information acquisition unit 1 are associated with the respective target numbers and stored in the target database 2.

In the control condition storage unit 3, the attribute information of the targets and viewpoint control conditions are associated with each other and stored. Specifically, the storage unit stores the conditions such as the conditions which cause the display mode of a target to differ from others when the degree of attention of the target is higher than the others as a result of determination of the attribute information. For example, viewpoint control conditions such as "set point A as the center of display, and set 70 kilometers as a display range" are associated with the attribute information "the type of the target is airplane, and the distance from point A is within a certain range". FIG. 2 is an example of the definition of the viewpoint control conditions stored in the control condition storage unit 3. The viewpoint control conditions can be set by combining (in multiple levels) a plurality of conditions such as the attribute information of the targets.

FIG. 2 shows that the viewpoint is controlled to "set the center of state display to the target position" only when matching all of the conditions that "the type of the target is airplane, the nationality of the target is not Japan, and the altitude of the target is 3000 feet or less". A plurality of conditions can be combined in this manner. Therefore, when there is an important change in the mode to which an observer should particularly pay attention, the viewpoint thereof can be controlled, and the important change in the mode can be displayed to the observer. If the viewpoint control conditions cannot be set in multiple levels and many airplanes are present, a plurality of targets match the viewpoint control conditions. As a result, the viewpoint of a display screen is frequently switched, and the display screen is hard for the observers to see. Therefore, setting the viewpoint control conditions in multiple levels is effective for causing the observer to recognize the target. The definition of the multiple-level viewpoint control conditions is described, for example, by XML.

When the target number is input from the information comparison unit 11, the viewpoint control unit 4 reads the latest attribute information, which is associated with this target number, from the target database 2. Subsequently, the attribute information that matches this read attribute information is detected from the control condition storage unit 3, and the viewpoint control conditions associated with the detected attribute information are extracted therefrom. Then, the viewpoint control unit 4 outputs the extracted viewpoint control conditions to the state display client unit 5.

Specifically, when the notification of the target number 100 is acquired from the information comparison unit 11, the viewpoint control unit 4 reads the attribute information, which is associated with the target number 100, from the target database 2. At this point, for example, when "flying object" is registered as a target type and position information is registered as a predicted landing point, whether the attribute information matching this attribute information is registered in the control condition storage unit 3 or not is determined. As a result, for example, when the attribute information that "the target type is a flying object, and the predicted landing point has been identified" is present, the viewpoint control conditions associated with the attribute information are extracted from the control condition storage unit 3, and the viewpoint control conditions are output to the state display client unit 5.

The state display client unit 5 carries out a process for switching the viewpoint display on the basis of the viewpoint control conditions acquired from the viewpoint control unit 4 and outputs the processed result to the display unit 9.

For example, when the information that "move a viewpoint angle from the left toward the right" is input as the viewpoint control condition, a process of controlling the viewpoint in that manner is carried out in the screen display of a control device, and the result thereof is output to the display unit 9.

Figure 3:
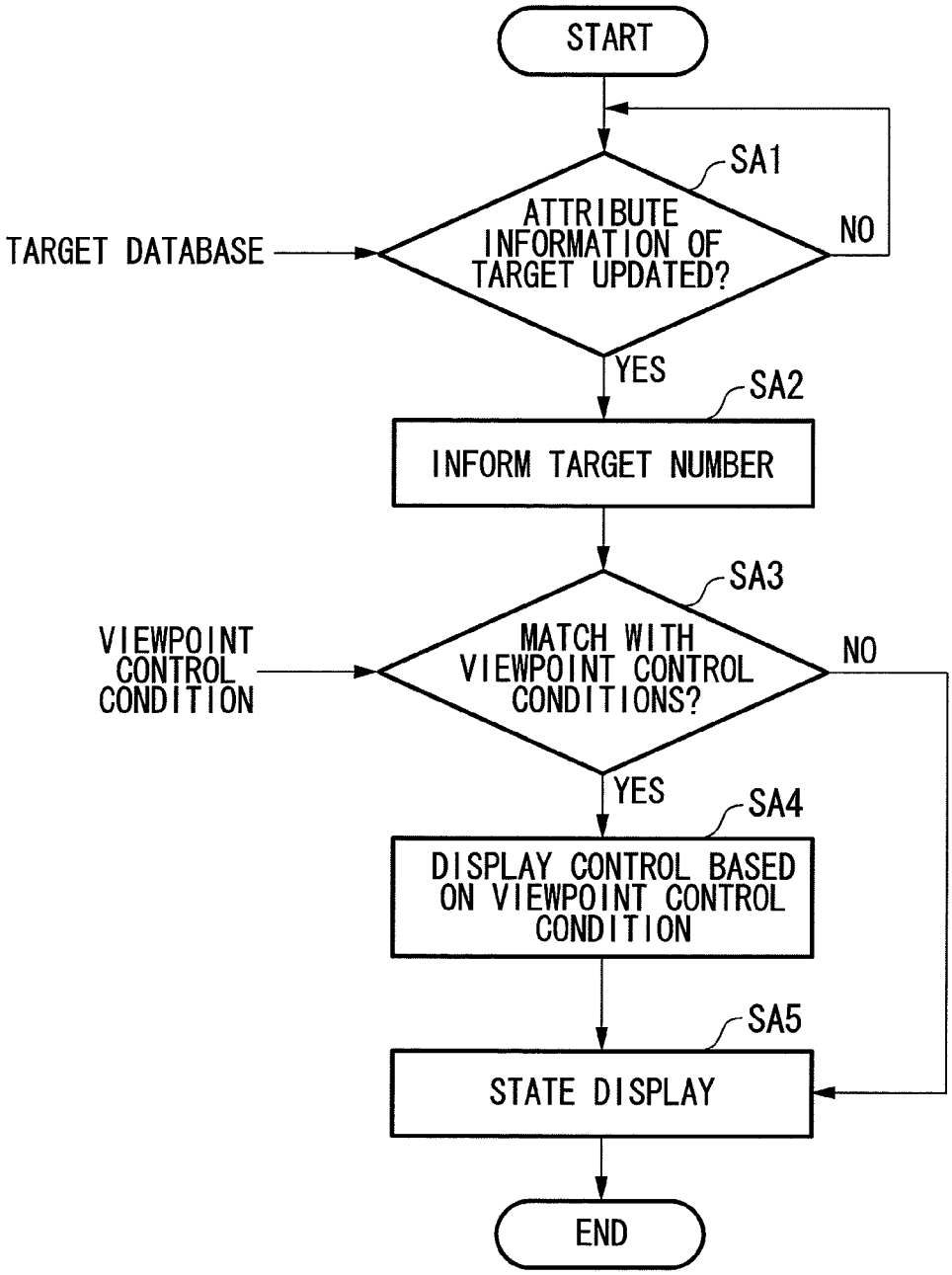
FIG. 3 is a diagram showing a working flow of a control display method according to the first embodiment of the present invention.

Next, operation of the control display system according to the present embodiment will be explained by using FIG. 3.

When the information of an object input by an observer or detected by a radar or the like is input to the information acquisition unit 1, in which a target number is allocated to the object, and the attribute information such as the type, course, speed, and position of the target is associated with the target number and output to the information comparison unit 11. In the information comparison unit 11, past (for example, the last) attribute information of the target number input from the information acquisition unit 1 is read from the target database 2, and the latest attribute information input this time and the past attribute information stored in the target database 2 are compared with each other (step SA1 of FIG. 3).

When the attribute information is different as a result of the comparison, the viewpoint control unit 4 is informed of the target number, and the viewpoint control unit 4 informs the target number of which attribute information has been changed (step SA2). On the other hand, when the attribute results are the same as a result of the comparison, step SA1 is repeated. Subsequently, the viewpoint control unit 4 carries out comparison to check whether the attribute information matching the attribute information read from the target database 2 is present in the control condition storage unit 3 or not (step SA3). When the attribute information matching the attribute information read from the target database 2 is determined to be present in the control condition storage unit 3 as a result of the comparison, the viewpoint control conditions associated with the attribute information are extracted therefrom, the extracted viewpoint control conditions are output to the state display client unit 5, and a process for switching the viewpoint display on the basis of the viewpoint control conditions is carried out (step SA4). The result of the screen which has undergone the viewpoint control is output to the display unit 5 of the control display system (step SA5), and the present process is then terminated. If the matching attribute information is determined to be not present in the control condition storage unit 3 as a result of the comparison, the present process is terminated without doing anything.

Figure 4:
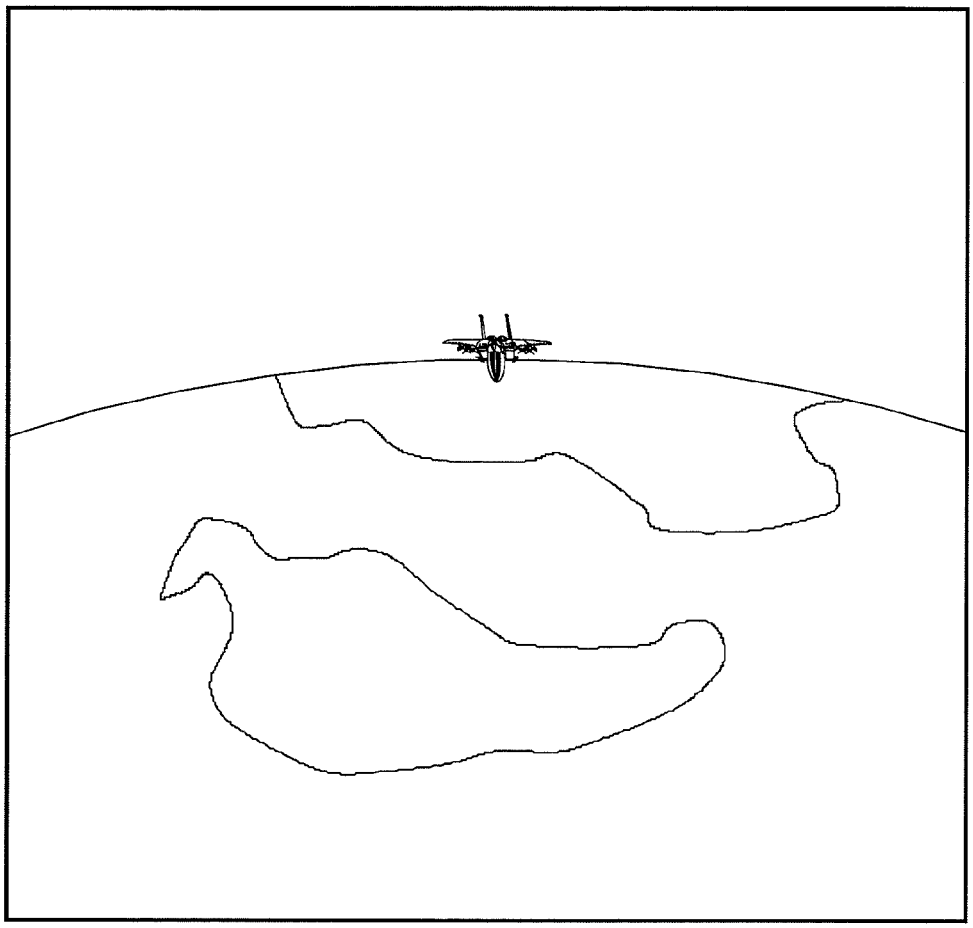
FIG. 4 shows an example of a screen of the case in which a viewpoint is switched in accordance with the viewpoint control conditions.
Figure 5:
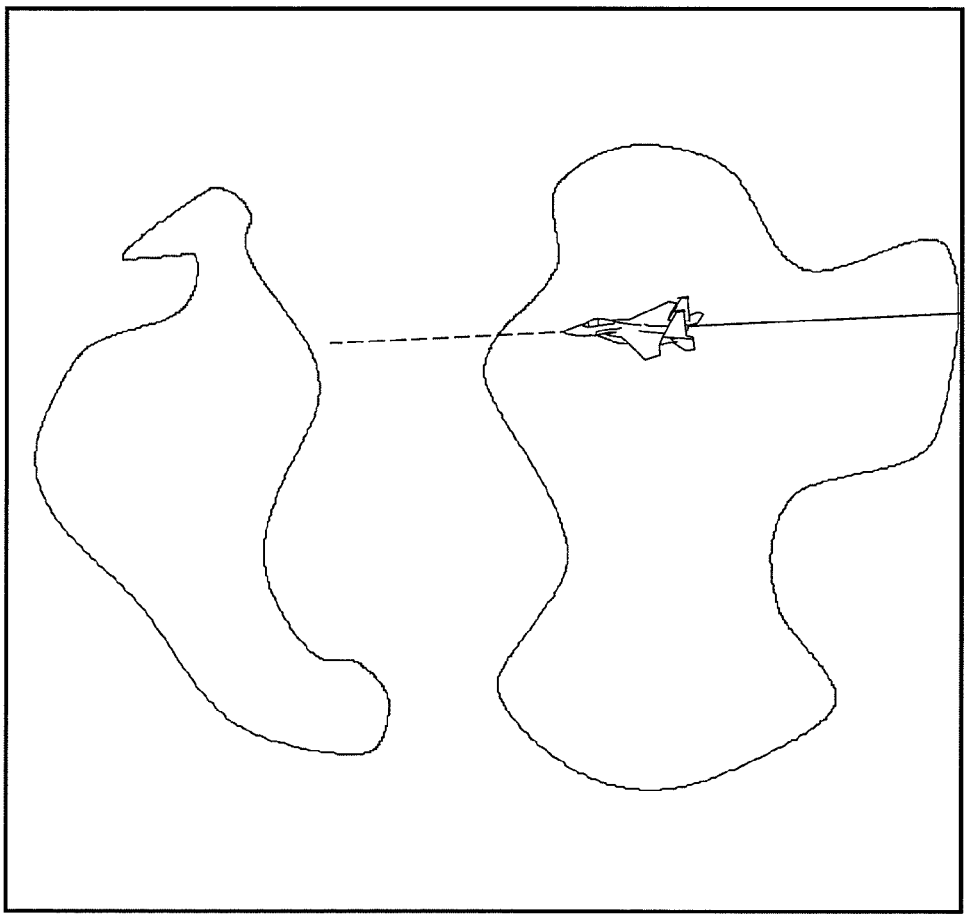
FIG. 5 shows an example of a screen of the case in which a viewpoint is switched in accordance with the viewpoint control conditions.

An example of viewpoint control is shown in FIG. 4 and FIG. 5. For example, in the case wherein a screen in which a target flies from the front side of the screen is displayed as shown in FIG. 4, when the viewpoint control conditions having the contents for switching the screen so that the target is seen in the manner that the target flies from the right side toward the left side of the screen are input to the state display client unit 5, the state display client unit 5 creates a screen so that the target flies from the right side toward the left side therein as shown in FIG. 5 and causes the display unit 9 to display the screen. As a result, the display screen of the target is switched from FIG. 4 to FIG. 5.

As described above, according to the control display system according to the present embodiment, the viewpoint control of the control display system is carried out in accordance with the detected change in the target state such as the target type, target course, speed, and position. In the case in which the viewpoint control is carried out, furthermore, a plurality of conditions for controlling, for example, the center position of display and display range are registered in accordance with states. Therefore, when an urgent situation, for example, in which a moving object is coming close to a neighboring area occurs, the viewpoint of state display can be automatically changed on the basis of the conditions. Thus, the observer of the control device can be caused to recognize the degree of urgency of the target.

In the present embodiment, the attribute information of the target acquired by the information acquisition unit 1 is compared with the previous attribute information of the target; and, only when the attribute information varies, the viewpoint control unit 4 is informed of that. However, the present invention is not limited to this configuration. For example, without comparing the attribute information of the target with the previous attribute information, the viewpoint control unit 4 may be directly informed of the attribute information of the target acquired by the information acquisition unit 1 without change.

In the present embodiment, the viewpoint control conditions are stored in advance in the control condition storage unit. However, as the conditions, already-determined viewpoint control conditions may be changed by the observer of the control display system, or conditions may be manually input by the observer. Such setting can be arbitrarily determined by a user.

In the example of the viewpoint control conditions in the present embodiment, the logical product "AND" is used to narrow down conditions; however, the present invention is not limited to this. For example, the logical sum "OR" for matching with more conditions can be used to define the conditions. Specifically, viewpoint control may be carried out when some sort of target is detected in the case of a mode in which targets such as airplanes are not present at all.

In the present embodiment, moving objects serve as the targets. However, the targets are not limited thereto. For example, objects which are not moving may serve as the targets.

Second Embodiment

Next, a second embodiment of the present invention will be explained by using FIG. 6.

Figure 6:
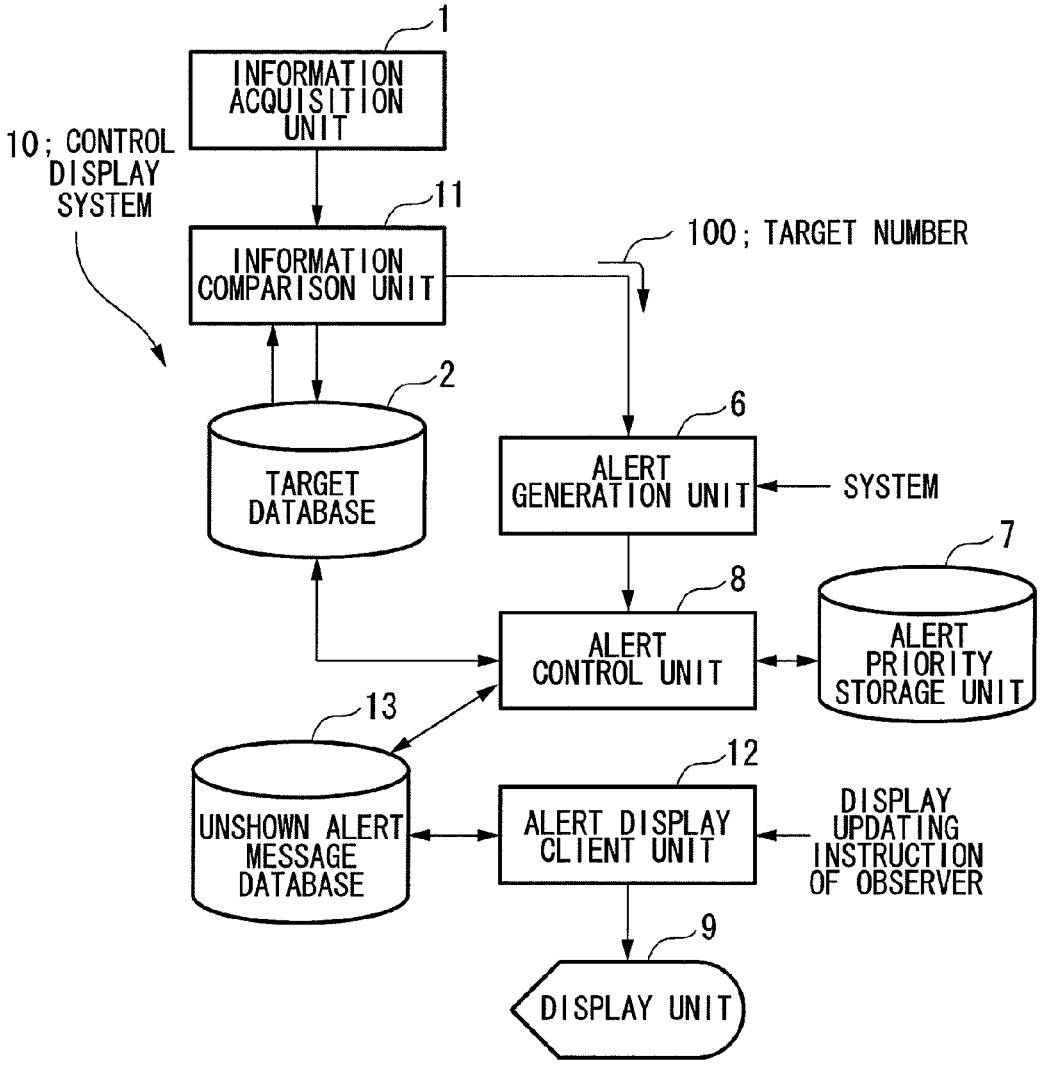
FIG. 6 is a functional block diagram showing an example of the configuration of a control display system according to a second embodiment of the present invention.

As shown in FIG. 6, a control display system of the present embodiment is different from the first embodiment in the point that: an alert generation unit 6, which generates alert information; an alert priority storage unit 7, which stores the priorities of alerts associated with the attribute information of the targets; an alert control unit 8, which determines the display order of the alerts in accordance with the priorities of the alerts associated with the attribute information of the targets; an alert display client unit 12, which displays alert messages; and an unshown alert message database 13 are provided instead of the viewpoint control unit, the control condition storage unit, and the state display client unit. Hereinafter, explanation about the points common to the first embodiment will be omitted, and different points of the control display system of the present embodiment will be mainly explained.

The target number is input from the information comparison unit 11 to the alert generation unit 6, and the information representing the state of the target is input to the alert generation unit 6. When the target number is input, the alert generation unit 6 gives a uniquely-determined fixed priority to the target and generates an alert message including the priority on the basis of the state of the target. The alert message is a notification which informs the observer of the state of the target and includes the information of the target number, the state of the target, and the priority. Herein, the priority given to the target information is set to be higher than the priority that is given to a system side, which will be described later. The priority of the alert represents the priority order for displaying the alert; wherein the smaller the value of the priority, the higher the priority.

The alert message is generated to be like, for example, "TARGET NUMBER 100 PRIORITY: MIDDLE "THE TARGET OF THE TARGET NUMBER 100 IS DETECTED"". The alert messages include the alert messages corresponding to a plurality of situations such as the case in which a new target is detected and the case in which the distance from a certain point is within a certain range.

Also, the information indicating that a system error has occurred is input to the alert generation unit 6 from the system side. When such information is input to the alert generation unit 6, the alert generation unit 6 gives a uniquely-determined fixed priority to the system error and generates an alert message including the priority.

The thus-generated alert message is output to the alert control unit 8.

When the alert control unit 8 acquires the alert message from the alert generation unit 6, the alert control unit 8 reads the latest attribute information, which is associated with the target number thereof, from the target database 2. Subsequently, the alert control unit 8 detects the attribute information matching the read attribute information and extracts the alert priority, which is associated with the detected attribute information, from the alert priority storage unit 7 (details will be described later). Then, the alert control unit 8 changes the priority of the alert message to the extracted alert priority, rearranges the display order of the alert messages which have already been generated but have not been shown, and stores them in the unshown alert message database 13. The alert display client unit 12 outputs the alert message having the highest priority and the number of the unshown alert messages to the display unit 9 in accordance with an alert updating instruction from the observer.

Specifically, when the alert control unit 8 acquires an alert message notification of the target number 100 from the alert generation unit 6, the alert control unit 8 reads the attribute information, which is associated with the target number 100, from the target database 2. In this case, for example, when "flying object" is registered as the target type and position information is registered as the predicted landing position, whether the attribute information matching this attribute information is registered in the alert priority storage unit 7 or not is determined. As a result, for example, if the attribute information that "the target type is a flying object, and the predicted landing point has been identified" is present, and the alert priority thereof is set to be 1 (highest), the priority of the alert message is changed to the alert priority 1 which is set in the alert priority storage unit 7. Then, the alert messages which have already been generated but have not been shown are read from the unshown alert message database 13, the display order of the alerts is rearranged in the descending order of the alert priorities, and the messages are stored in the unshown alert message database 13. The alert display client unit 12 outputs the alert message having the highest priority and the number of the unshown alert messages to the display unit 9 in accordance with the alert updating instruction from the observer.

The attribute information of the targets and the alert priorities are associated with each other and stored in the alert priority storage unit 7. Specifically, the attribute information such as the type, altitude, arrival position, speed, and direction of the targets are stored as conditions, and the alert priorities are attached thereto and stored. For example, the information for changing the priority to 1 (highest) when the target attribute information is "the target type is a flying object, and the predicted landing point has been identified" is stored. Also, an alert priority such as 2 (normal) is stored for the target attribute information that "the target type is unknown". FIG. 7 shows an example of the definition of the alert priority stored in the alert priority storage unit 7. For example, such a definition is described by XML or the like.

Figure 8:
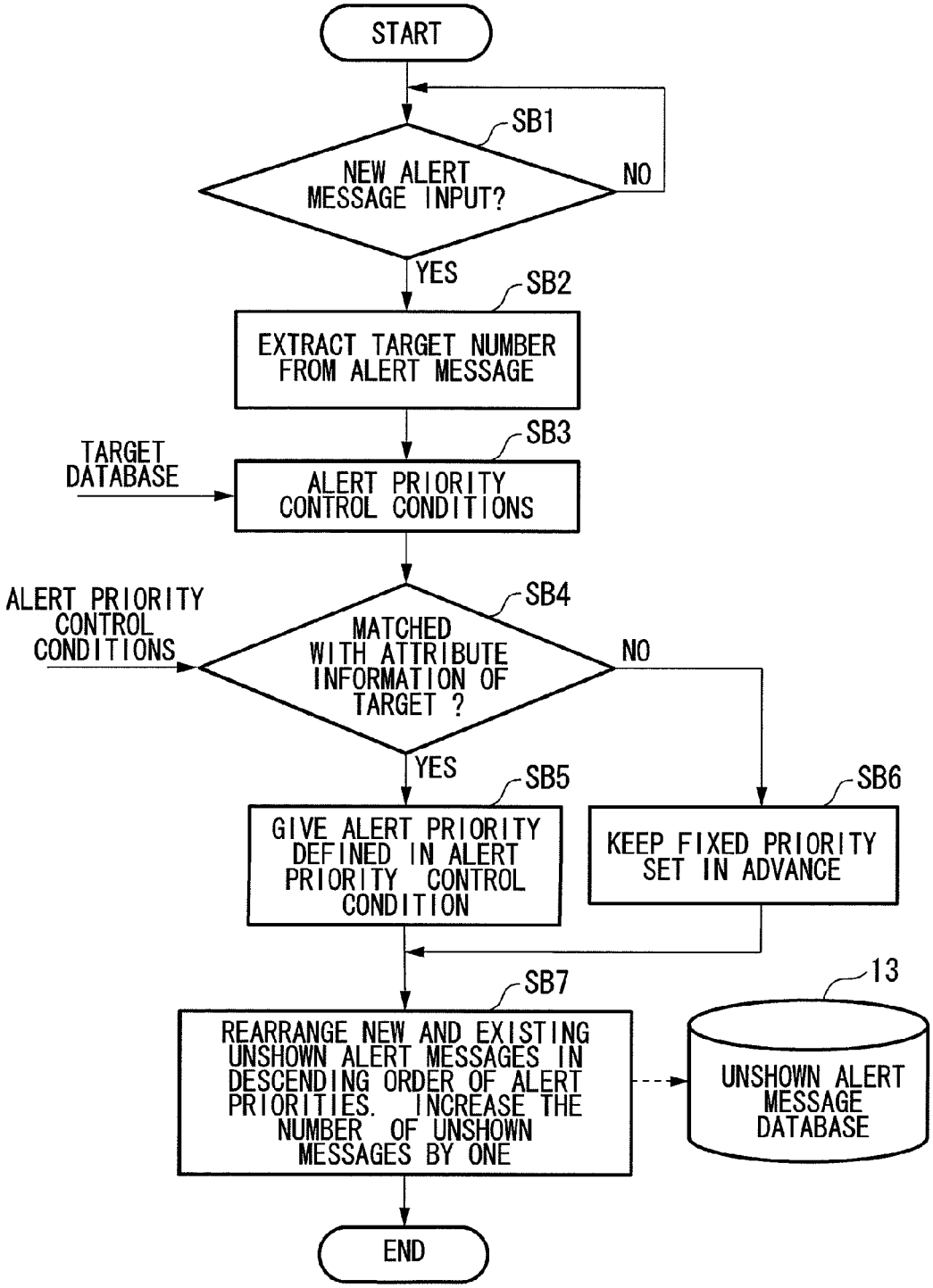
FIG. 8 is a diagram showing a working flow in which a priority is given to an alert message of a control display method according to the second embodiment of the present invention.
Figure 9:
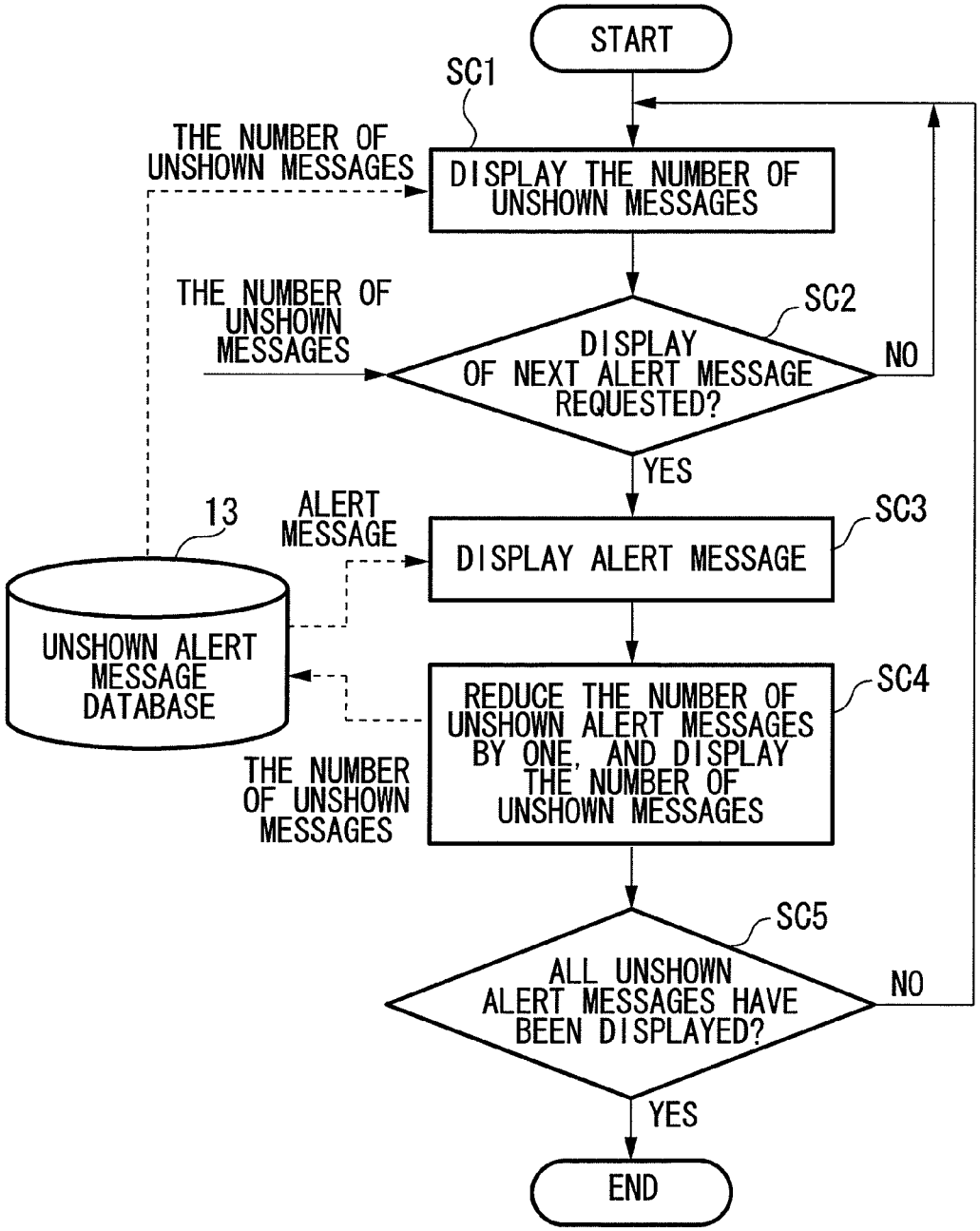
FIG. 9 is a diagram showing a working flow of display of the alert message of the control display method according to the second embodiment of the present invention.

Next, operation of the control display system according to the present embodiment will be explained by using FIG. 8 and FIG. 9. FIG. 8 is a working flow for generating the unshown alert database with generated alerts on the basis of alert priorities.

When the information of an object input by an observer or detected by a radar or the like is input to the information acquisition unit 1, in which a target number is allocated to the object, and attribute information such as the type, course, speed, and position of the target is associated with the target number and output to the information comparison unit 11. In the information comparison unit 11, the past (for example, the last) attribute information of the target acquired from the information acquisition unit 1 is read from the target database 2, and the latest attribute information input this time and the past attribute information stored in the target database 2 are compared with each other (step SB1 of FIG. 8).

When the attribute information varies, as a result of the comparison, the alert generation unit 6 is informed of the target number, etc., and an alert message of the target number is generated in the alert generation unit 6. The generated alert message is output to the alert control unit 8. The alert control unit 8 reads the attribute information, which is associated with the corresponding target number, from the target database 2 (step SB2). On the other hand, when the attribute information is the same as a result of the comparison, step SB1 is repeated.

Subsequently, the target attribute information, which is associated with the target number matching the extracted target number, is extracted from the target database 2 (step SB3). Furthermore, whether the attribute information serving as the alert priority control conditions and matching the extracted target attribute information is present in the alert priority storage unit or not is determined (step SB4). When the matching attribute information is present as a result of the determination, the alert priority read from the alert priority storage unit 7 is given to the message (step SB5). On the other hand, when there is no matching attribute information as a result of the determination, the fixed alert priority given by the alert generation unit 6 is kept, and the priority is not changed (step SB6). Next, unshown alert messages and the number of unshown alert messages are read from the unshown alert message database 13, the messages including the new alert message are rearranged in the descending order of the alert priorities, the number of the unshown alert messages is increased by one and stored in the unshown alert message database 13 (step SB7), and the present process is terminated.

Next, a working flow of alert message display will be explained by FIG. 9. When an unshown alert message is generated, the alert display client unit 12 displays the number of unshown display messages on the display unit 9 (step SC1 of FIG. 9). The presence/absence of a request of a display updating instruction from an observer is determined (step SC2). If there is no request, the process returns to the beginning without doing anything. If there is the request, an alert message is read from the unshown alert message database 13, in which the messages are arranged in the descending order of the alert priorities, and displayed on the display unit 9 (step SC3). Furthermore, the number of the unshown alert messages is reduced by one, the number is shown on the display unit 9, and the number of unshown alert messages is stored in the unshown alert database 13 (step SC4). Whether all of the unshown alert messages have been displayed or not is determined; and, if all of them have been displayed, the present process is terminated. If any unshown message remains, the process returns to the beginning of the present process (step SC5).

As described above, according to the control display system according to the present embodiment, the order of displaying the alert messages can be determined in accordance with the contents of the alerts, and the messages can be rearranged so that display of the alert messages having higher priorities is prioritized. Thus, the observer of the control display system can easily be caused to recognize the alert message having a high degree of urgency such as a message that a dynamic object is coming closer to a neighboring area.

In the present embodiment, the target attribute information acquired by the information acquisition unit 1 is compared with the previous target attribute information; and, only when the attribute information varies, the alert generation unit 6 is informed of that. However, the present invention is not limited thereto. For example, without comparing the target attribute information with the previous attribute information, the alert generation unit 6 may be directly informed of all of the target attribute information acquired by the information acquisition unit 1.

In the present embodiment, the priorities of the alerts are stored in advance in the alert priority storage unit. However, the priorities may be changed by the observer of the control display system or may be manually input by the observer. Such setting can be arbitrarily carried out by the user.

REFERENCE SIGNS LIST

1 INFORMATION ACQUISITION UNIT
2 TARGET DATABASE
3 CONTROL CONDITION STORAGE UNIT
4 VIEWPOINT CONTROL UNIT
5 STATE DISPLAY CLIENT UNIT
6 ALERT GENERATION UNIT
7 ALERT PRIORITY STORAGE UNIT
8 ALERT CONTROL UNIT
9 DISPLAY UNIT
10 CONTROL DISPLAY SYSTEM
11 INFORMATION COMPARISON UNIT
12 ALERT DISPLAY CLIENT UNIT
13 UNSHOWN ALERT MESSAGE DATABASE

The invention claimed is:

1. A control display system comprising:

an information acquisition unit that acquires a target serving as an object of monitoring and attribute information of the target;

a control condition storage unit that stores the attribute information of the target and a viewpoint control condition serving as information about a display mode of the target, the attribute information and the condition being associated with each other in advance;

a viewpoint control unit that detects attribute information matching the attribute information of the target acquired by the information acquisition unit from the control condition storage unit and that extracts the viewpoint control condition associated with the detected attribute information; and a display unit that displays a result obtained by carrying out viewpoint control of the target on the basis of the viewpoint control condition extracted by the viewpoint control unit.

2. The control display system according to claim 1, further comprising an information comparison unit that compares the attribute information of the target acquired from the information acquisition unit with past attribute information of the target and that determines whether the attribute information is changed or not, wherein;

when the attribute information is changed, the viewpoint control unit extracts the viewpoint control condition.

3. The control display system according to claim 1, wherein the attribute information of the target is set in multiple levels in the control condition storage unit.

4. A control display system comprising:

an information acquisition unit that acquires a target serving as an object of monitoring and attribute information of the target;

an alert priority storage unit that stores the attribute information of the target and an alert priority serving as an order of an alert message, the attribute information and the alert priority being associated with each other;

an alert control unit that detects attribute information matching the attribute information of the target acquired by the information acquisition unit from the alert priority storage unit and that extracts the alert priority associated with the detected attribute information; and a display unit that displays the alert message on the basis of the extracted alert priority.

5. The control display system according to claim 4, wherein when an unshown message is present other than the alert message displayed by the alert display unit, the number of the unshown message is displayed.

6. A control display method comprising:

a first step for acquiring a target serving as an object of monitoring and attribute information of the target;

a second step for detecting attribute information matching the attribute information of the target acquired in the first step from information including the attribute information of the target and a viewpoint control condition serving as information about a display mode of the target, which are associated with each other in advance, and for extracting the viewpoint control condition associated with the detected attribute information; and a third step for displaying a result obtained by carrying out viewpoint control of the target on the basis of the viewpoint control condition extracted in the second step.

7. A non-transitory computer readable recording medium having stored thereon a control display program for causing a computer to execute:

a first process for acquiring a target serving as an object of monitoring and attribute information of the target;

a second process for detecting attribute information matching the attribute information of the target acquired in the first process from information including the attribute information of the target and a viewpoint control condition serving as information about a display mode of the target, which are associated with each other in advance, and for extracting the viewpoint control condition associated with the detected attribute information; and a third process for displaying a result obtained by carrying out viewpoint control of the target on the basis of the viewpoint control condition extracted in the second process.

8. A control display method comprising:

a first step for acquiring a target serving as an object of monitoring and attribute information of the target;

a second step for detecting attribute information matching the attribute information of the target acquired in the first step from information including the attribute information of the target and an alert priority serving as an order of an alert message, which are associated with each other, and for extracting the alert priority associated with the detected attribute information; and a third step for displaying the alert message on the basis of the extracted alert priority.

9. A non-transitory computer readable recording medium having stored thereon a control display program for causing a computer to execute:

a first process for acquiring a target serving as an object of monitoring and attribute information of the target;

a second process for detecting attribute information matching the attribute information of the target acquired in the first process from information including the attribute information of the target and an alert priority serving as an order of an alert message, which are associated with each other, and for extracting the alert priority associated with the detected attribute information; and a third process for displaying the alert message on the basis of the extracted alert priority.

10. The control display system according to claim 2, wherein the attribute information of the target is set in multiple levels in the control condition storage unit.

11. The control display system according to claim 4, further comprising an alert generation unit that generates the alert message including the attribute information and information of a uniquely-determined fixed priority to the target, wherein the alert control unit changes the fixed priority of the alert message to the extracted alert priority.

12. The control display method according to claim 8, further comprising a step for generating the alert message including the attribute information and information of a uniquely-determined fixed priority to the target, wherein the third step includes changing the fixed priority of the alert message to the extracted alert priority.

13. The non-transitory computer readable recording medium according to claim 9, wherein the control display program further causes the computer to execute a process of generating the alert message including the attribute information and information of a uniquely-determined fixed priority to the target, and the third process includes changing the fixed priority of the alert message to the extracted alert priority.

* * * * *